United States Patent [19]

Reifers et al.

[11] 4,162,759

[45] Jul. 31, 1979

[54] FOOD PACKAGING TRAY

[75] Inventors: Richard F. Reifers, New Canaan, Conn.; Kenneth D. Bixler, Huntington, N.Y.

[73] Assignee: Diamond International Corporation, New York, N.Y.

[21] Appl. No.: 931,212

[22] Filed: Aug. 4, 1978

Related U.S. Application Data

[63] Continuation of Ser. No. 866,131, Dec. 30, 1977.

[51] Int. Cl.[2] ..... B65D 1/00; B65D 65/00

[52] U.S. Cl. ..... 229/2.5 R; D9/219

[58] Field of Search ..... 229/2.5 R; D9/219

[56] References Cited

U.S. PATENT DOCUMENTS

| | | | |
|---|---|---|---|
| D. 223,658 | 5/1972 | Reifers et al. | D9/219 |
| D. 231,200 | 4/1974 | Reifers et al. | D9/219 |
| 2,918,379 | 12/1959 | Lurie | 99/174 |
| 3,056,232 | 10/1962 | Chaplin | 47/34 |
| 3,067,921 | 12/1962 | Reifers | 229/2.5 |
| 3,185,371 | 5/1965 | Reifers | 229/2.5 R |
| 3,217,962 | 11/1965 | Weiss | 229/2.5 |
| 3,220,631 | 11/1965 | Reifers | 229/2.5 |
| 3,357,625 | 12/1967 | Malmgren | 229/2.5 |
| 3,409,199 | 11/1968 | Lake | 229/2.5 |
| 3,420,431 | 1/1969 | Donovan | 229/2.5 |
| 3,450,326 | 6/1969 | Foote | 229/2.5 |
| 3,480,178 | 11/1969 | Morgan | 220/97 |
| 3,489,270 | 1/1970 | Bixler et al. | 206/45.31 |
| 3,494,502 | 2/1970 | Roush et al. | 220/66 |
| 3,549,018 | 12/1970 | Wilson | 220/97 |
| 3,682,365 | 8/1972 | Reifers et al. | 229/2.5 R |
| 3,698,623 | 10/1972 | Bixler | 229/2.5 R |
| 3,718,274 | 2/1973 | Reifers et al. | 229/2.5 R |
| 3,727,791 | 4/1973 | Fraser et al. | 220/66 |
| 3,756,492 | 9/1973 | Reifers et al. | 229/2.5 R |
| 3,764,057 | 10/1973 | Reifers et al. | 229/2.5 R |
| 3,894,679 | 7/1975 | Reifers et al. | 229/2.5 R |
| 3,986,655 | 10/1976 | Rynning | 229/2.5 R |

FOREIGN PATENT DOCUMENTS

| | | |
|---|---|---|
| 187346 | 2/1972 | Argentina . |
| 1051189 | 2/1959 | Fed. Rep. of Germany . |
| 6605571 | 4/1971 | Fed. Rep. of Germany . |
| 1108591 | 1/1956 | France . |
| 338272 | 5/1969 | Sweden . |
| 714850 | 9/1954 | United Kingdom . |
| 1035182 | 7/1966 | United Kingdom . |
| 1252233 | 11/1971 | United Kingdom . |

*Primary Examiner*—Davis T. Moorhead

*Attorney, Agent, or Firm*—Karl W. Flocks

[57] ABSTRACT

A throw-away, one-use tray, for the packaging of easily bruised fruit and produce in conjunction with an overwrap plastic film, is provided with an open-window bottom configuration in which the bottom ribs defining the open windows are approximately 20% greater thickness than the side walls of the tray. The rib form at the bottom serves the functions of stiffening the bottom more than would ribs resulting from die cut openings, and creating a smooth rolled edge in contact with the produce to reduce cutting and bruising.

7 Claims, 7 Drawing Figures

FOOD PACKAGING TRAY

This is a continuation of application Ser. No. 866,131, filed Dec. 30, 1977.

FIELD OF INVENTION

The present invention relates to food packaging and, more particularly, to a produce tray used in conjunction with an overwrap plastic film and which is of adequate strength without causing damage to the packaged produce while providing good visibility.

BACKGROUND

It is, of course, well known to make food packaging trays of molded wood pulp, and also of foam plastic, e.g., polystyrene. Particularly, the molded wood pulp food trays have served the food packaging industry well for many years. Such wood pulp trays have the advantage, besides low price and cost to the consumer, of being clean, sturdy and safe; of being biodegradeable so as to minimize the problem of solids pollution; of being soft and relatively flexible so as to protect and prevent bruising of food products such as fresh fruit and tomatoes; and of being capable of controlling excess moisture. In contrast, foam polystyrene has only some of these advantages while transparent plastic normally has none of these advantages.

Indeed, these clear plastic trays have many defects, some shared with foam plastic trays, including reduced strength, increased cost, use of our valuable petroleum resources, fabrication of non-biodegradeable material, and hard surfaces and sharp edges which bruise and cut the fruit. In addition, such plastic trays do not breathe, i.e., permit passage therethrough of air and water vapor, and more importantly they also collect moisture in puddles, thereby encouraging discoloration and rotting; in addition, any moisture which accumulates then serves to opacify the package itself, thereby contributing to the very problem of lack of visibility through the bottom wall which such trays were originally designed to overcome.

Food packaging trays have evolved substantially over the years. Earlier trays had essentially straight side walls and a flat peripheral lip, and these served the industry successfully for many years, particularly for the packaging of meat. In more recent years, such earlier trays were used for the packaging of produce, such as a half dozen deluxe apples or oranges, provided with a transparent film overwrap. However, as the nature of transparent plastic wrap film changed and nonelastic cellophane was replaced with more elastic thermoplastic overwrap films, the trays in accordance with the Reifers U.S. Pat. No. 3,185,371 was developed, and this tray became the leader in the field. In more recent years, there has been an increase in a desire for greater visibility of the food packages.

Among the unsuccessful attempts to provide a produce tray formed of opaque material such as wood pulp was to simply take a conventional solid bottom tray and die cut openings in the bottom wall. This was not found to be a successful approach to the problem because the resultant tray was too weak and it was also unstable to warpage. In addition, the die-cutting operation, even if carried out on an adherently soft and flexible material, inevitably produces sharp edges which can cut or bruise sensitive produce. This is a particularly acute problem in the packaging of produce because even a very slight edge or roughness can cause an undesirable indentation in soft fruit, even if the skin of the fruit is not broken.

The Reifers et al. U.S. Pat. No. 3,682,365 presents a good description of the evolution of one-use, throw-away food packaging trays formed of opaque material and having bottom wall visibility by the provision of openings in the bottom wall. The Bixler U.S. Pat. No. 3,698,623 discloses such a meat packaging tray having inverted V-shaped ribs. The Reifers et al. U.S. Pat. Nos. 3,718,274 and 3,764,057 show highly successful commercial embodiments of such meat packaging trays with open-window bottom walls.

However, it will be understood that while such constructions, as noted above, are suitable for the packaging of meat, they are normally not so suitable for the packaging of fruit and produce, which is easily bruised inside the package by sharp rib contours, and between packages as they are stacked. To meet this particular need, trays of the type disclosed in the Reifers et al. U.S. Pat. No. 3,756,492 have been utilized. These latter produce trays work well and have been successful, but there is still room for improvement.

SUMMARY

It is, accordingly, an object of the present invention to overcome deficiencies in the prior art.

It is a further object to provide for improved packaging of sensitive produce, such as tomatoes and other fruit.

It is another object of the invention to provide a molded, nestable tray, preferably formed of wood pulp or the like, primarily for the packaging of sensitive produce or the like and which, in spite of being made of generally opaque or at best translucent material, provides a relatively high degree of visibility of the packaged product.

It is another object of the present invention to provide for the clean, safe and effective packaging of easily damaged food products.

It is another object to provide a produce tray which provides even better protection than the trays of Reifers et al. U.S. Pat. No. 3,756,492.

It is a further object to provide a tray for the packaging of soft produce which not only protects the produce packaged within the tray itself, but also presents no problems of bruising or cutting of produce stacked therebeneath.

It is another object of the present invention to provide a produce tray which, although being primarily open on the bottom, is sufficiently strong to be handled under all conditions.

It is another object of the present invention to provide a product packaging tray which may provide from a minimum of 55% bottom visibility and up to about 85% total visibility on certain round fruits (entire surface of produce packaged) and which also tends to softly support the produce without bruising or other damage.

To accomplish these and other objectives, a new tray is provided in which the ribs, defining the open-window bottom wall, do not extend upwardly a significant degree, nor do they extend horizontally into any of the four side walls. Such ribs remain flat on the existing bottom of the tray without any substantial groove indentation and define a smooth window frame about each open window. In addition, the terminal peripheral portion of each window frame is disposed at a level lower than the level on which the fruit is supported, so that any sharp edge, such as might result from flash during molding, will not come into contact with the fruit packaged. In general, the necessary strength is provided by molding the tray in such a way that the frame formed about each window adds to the total bottom structure in combination with the fact that the thickness of such ribs is on the order of 20% greater than the thickness of the side walls of the tray.

For a better understanding of the invention as well as other objects and the nature and advantages of the instant invention, possible embodiments thereof will now be described with reference to the attached drawing, it being understood that these embodiments are intended as merely exemplary and in no way limitative.

DETAILED DESCRIPTION OF SPECIFIC EMBODIMENTS

Figure 1:
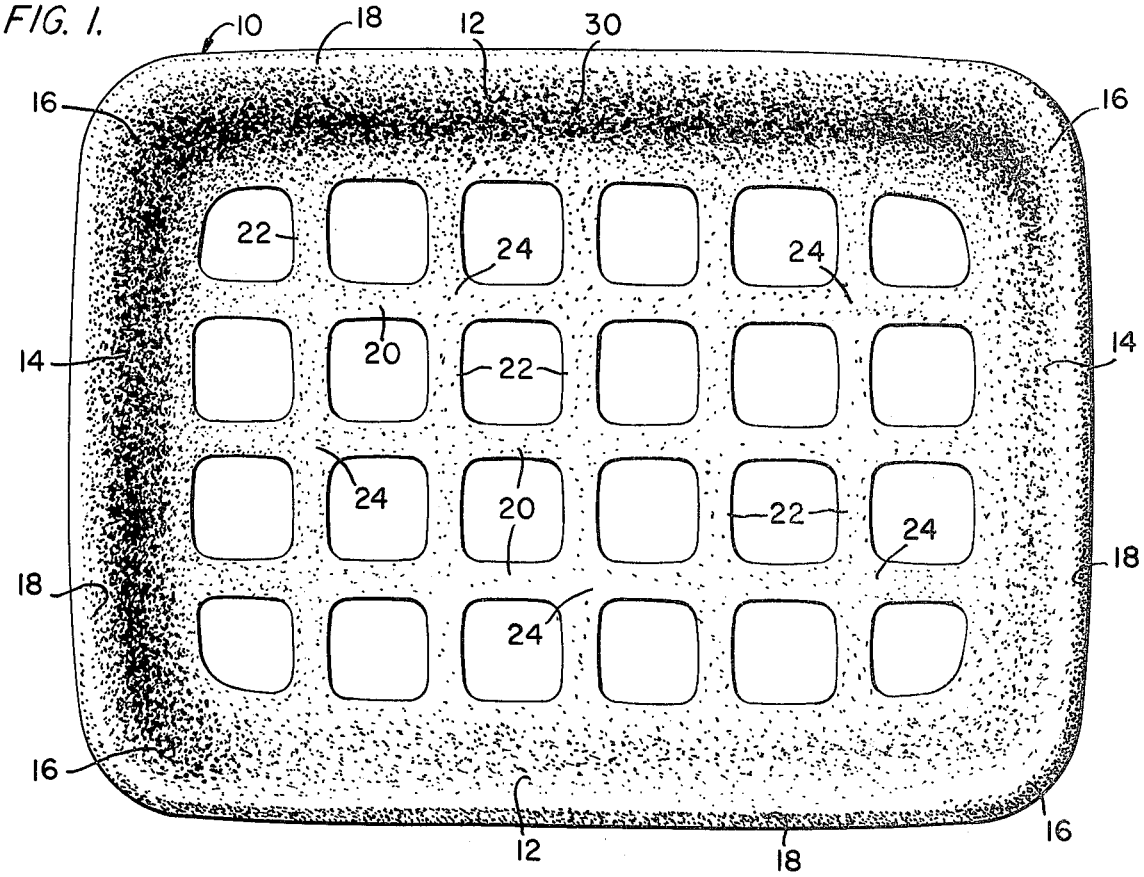
FIG. 1 is a top plan view of an embodiment of a tray in accordance with the present invention.

Noting FIG. 1, it will be seen that a tray 10 is provided, primarily intended for the packaging of produce, although it will be understood that any food products could be packaged therein, in association with an overwrap film of transparent material such as heat-sealable, stretchable or shrinkable plastic film, or heat-sealable cellophane. As is conventional, the product tray 10 has two upwardly and outwardly inclined opposite side walls 12 and two upwardly and outwardly inclined opposite end walls 14, both the end walls and the side walls being preferably bowed as described in the Reifers U.S. Pat. No. 3,185,371. As is conventional, each adjacent end and side walls merge at a rounded corner 16, and the side and end walls terminate at their upper ends in a curved, outwardly extending peripheral lip 18.

Instead of having a flat bottom wall as in Reifers U.S. Pat. No. 3,185,371, or an open-window bottom wall defined by V-shaped ribs as in Reifers et al. U.S. Pat. No. 3,756,492, the tray 10 is provided with a plurality of intersecting ribs 20,22 which are generally flat on the inside, upper surface, with downwardly rounded corners 25. The ribs 20 extend along the bottom generally parallel to the side walls 12, while the ribs 22, preferably at right angles to the ribs 20, extend generally parallel to the end walls 14. The generally flat ribs 20 and 22 cross at generally cruciform areas 24.

Figure 5:
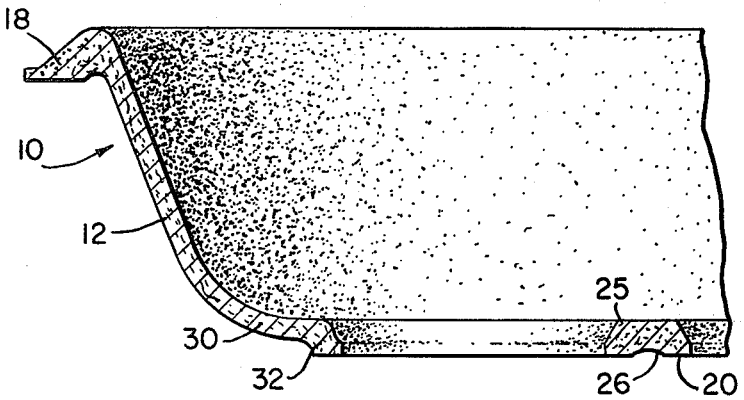
FIG. 5 is an enlarged section taken along line 5—5 of FIG. 4.
Figure 6:
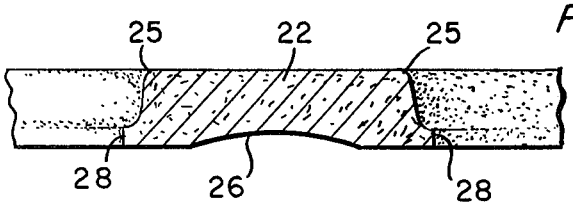
FIG. 6 is an enlarged section taken along line 6—6 of FIG. 4.
Figure 7:
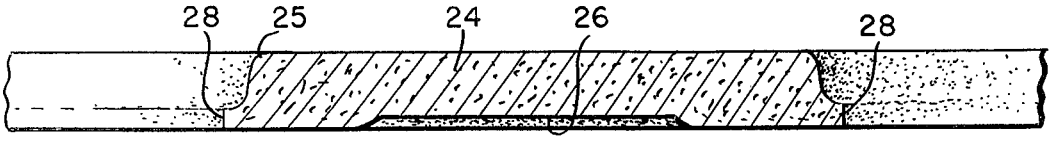
FIG. 7 is an enlarged section taken along line 7—7 of FIG. 4.

As best seen in FIGS. 5 and 6, the ribs 20 and 22, which are of identical cross-sectional shape, it being understood that FIG. 6 is enlarged to a greater degree than is FIG. 5, form in cross-section almost trapezoidal shapes, the opening-defining edge of each rib being well below the rib upper surface on which the produce rests. In particular, the ribs 20 and 22 are designed to have small flanges 28 at the bottom edges thereof (see FIG. 6) which form the terminal peripheral portion of each window frame; however, it will be understood that in the mass-produced tray such flanges 28 may vary in horizontal dimension and in some cases may not be present. Also as in both FIGS. 5 and 6, there is a tendency during the forming operation, when formed in the usual way from wood pulp, to produce a slight cavity 26 at the bottom of each rib. At the areas 24, where the ribs 22 and 20 cross, the cavity 26 is somewhat larger as seen in FIG. 7. When molded of wood pulp, the screen texture will be on the interior of the tray, contrary to Reifers et al. U.S. Pat. No. 3,756,492.

Figure 2:
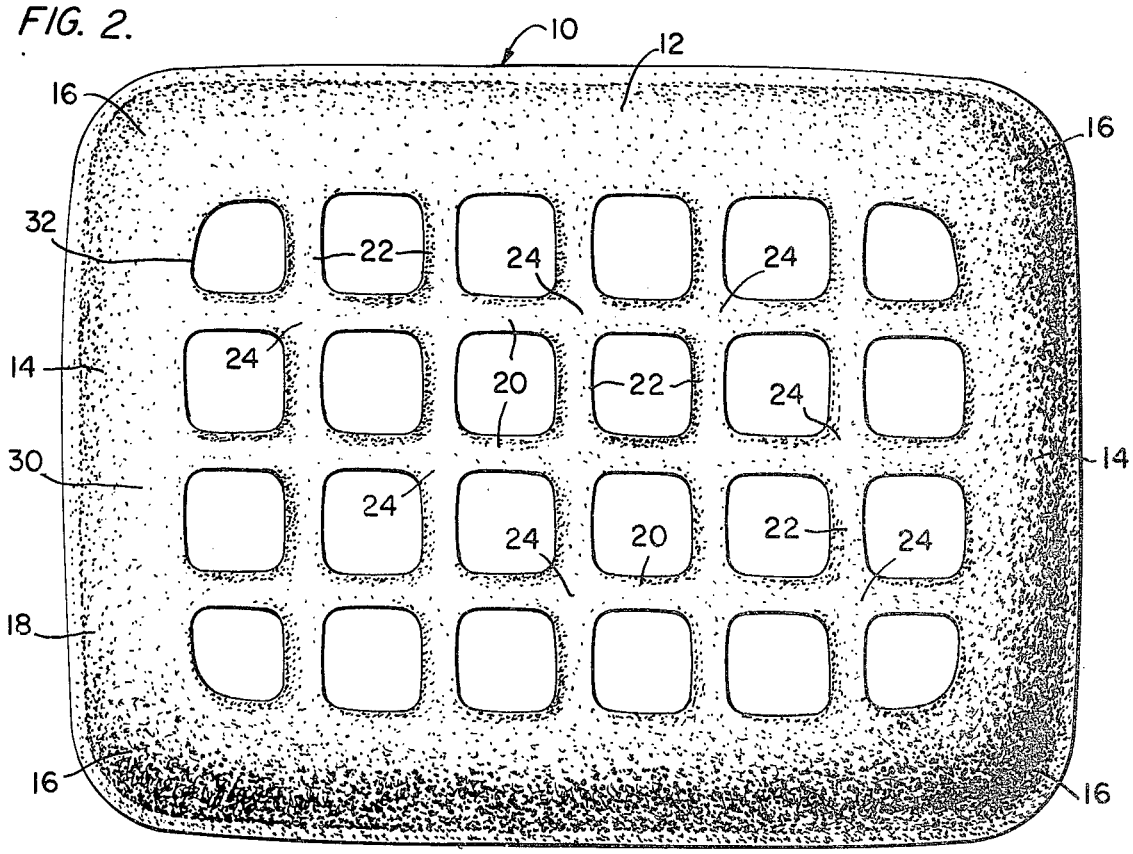
FIG. 2 is a bottom plan view of the tray of FIG. 1.
Figure 3:
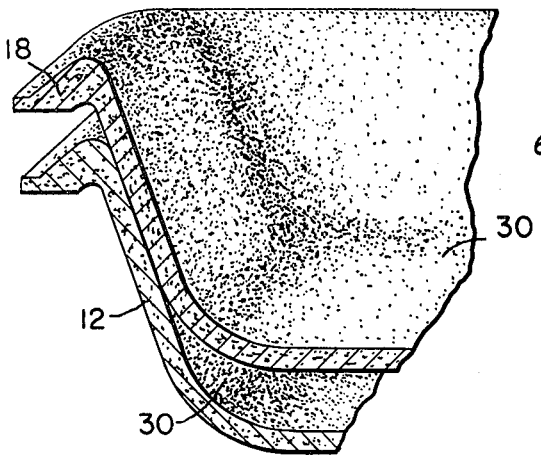
FIG. 3 is a detail showing the lips of two nested trays in accordance with the embodiment of FIG. 1, said view being partly in perspective, partly broken away and partly in section.
Figure 4:
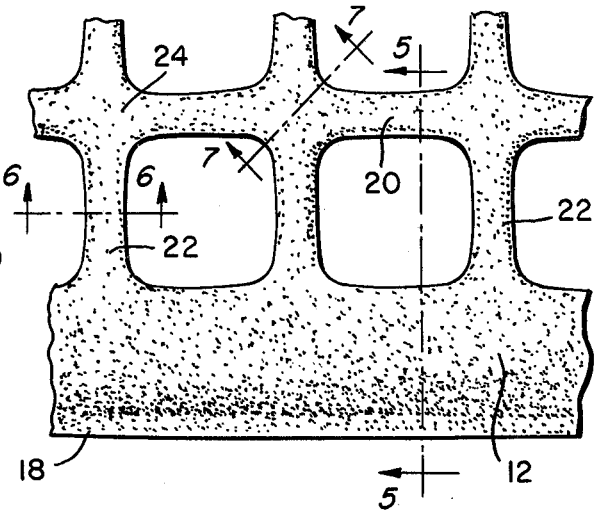
FIG. 4 is an enlarged top plan view of the tray of FIG. 1, partly broken away.

It will be noted that the end and side walls 14 and 12 blend smoothly and directly into the ribs 20 and 22 by way of a rounded annular portion 30. On the inside of the tray 10, as seen in FIG. 1, the annular portion 30 blends smoothly and directly into the ribs 20 and 22 without any transition. On the outside of the tray 10, as seen in FIG. 2, and as best seen in FIG. 5, there is a more or less abrupt transition from the annular portion 30 to a thickened portion 32 which is analogous to a rib and forms part of the "window-frame" for the open windows closest to the walls of the tray.

A very important feature of the present invention is the location and, more particularly, the height of the terminal peripheral portion of each window frame, such as defined by the flange 28; it is essential that this portion be located below the upper plane of the ribs. This is so because regardless of how any open-windowed tray is formed, there is a tendency to create sharp edges at the window edge, e.g., in the form of "flash" when the tray is molded. By locating such window edge below the upper surfaces of the ribs on which the produce rests, any "flash" which occurs will be out of contact with the produce.

This construction, along with providing the ribs with the rounded upper edges 25, serves to avoid cutting or bruising of the produce. If any flash forms during molding, it will extend vertically and cannot reach a location where it would contact the produce. Moreover, the application of film overwrap will smooth any flash extending downwardly thereby avoiding cutting packages stacked therebelow.

Another important feature of the present invention involves the thickness of the ribs 20 and 22. Thus, such ribs are normally of height, i.e., thickness, about 90 to 100 mils. Since the side walls 12 and the end walls 14 are about 1 inch in height, this means that the thickness of the ribs 20 and 22 is no more than about one-tenth the height of the tray. Moreover, particularly when formed of molded pulp, the walls 12 and 14 are normally about 70 to 80 mils thick so it will be seen that the ribs 20 and 22 are approximately 20% thicker than the walls 12 and 14. Because of the forming mechanism when molding wood pulp, sometimes the depth of the cavity 26, particularly in the cruciform area 24, will reduce the thickness of the rib thereabove to as little as 65 mils, but the over-all cross-section of the ribs 20 and 22 remain sufficiently thick, on the order of 20% greater than the thickness of the walls 12 and 14, so as to provide the tray with sufficient strength.

With regard to the peripheral lip 18, it is preferred to use the lip disclosed in the Reifers U.S. Pat. No. 3,185,371, although the stronger lip disclosed in the Reifers et al. U.S. Pat. No. 3,761,011 can also be used. This latter lip was originally developed for shallow meat trays, although it finds utility in other types of trays as well. For the original use, the major consideration was a lip to resist inward deflection, keeping maximum strength under conditions even when the tray became wet. When a tray is used for packaging meat, the meat is normally cut to fit the package and may protrude a little above or against the top edge. In contrast thereto, produce is normally packed so as to extend considerably above the top of the tray, thereby exerting film tension from a higher elevation, and sometimes also tending to bulge the lip upwardly to more closely fit the produce. Accordingly, the nature of the packaging makes a more flexible lip form, i.e., that of Reifers U.S. Pat. No. 3,185,731, somewhat more desirable for produce than the more rigid lip of Reifers et al. U.S. Pat. No. 3,761,011. Thus, the lip of the earler Reifers U.S. Pat. No. 3,185,371 has less inward deflection resistance, but greater "beam strength" to resist longitudinal deflection and also an ability to flex and return to original shape rather than fracturing. This combination of features better meets the use requirements of produce trays.

On the other hand, the conventional flat lip which was used prior to Reifers U.S. Pat. No. 3,185,371 is not as satisfactory in the present environment, since it does not provide the tray with sufficient side wall deflection resistance, and also is unable to retain the shape of the tray.

As noted above, the tray of the present invention is preferably molded from wood or paper pulp. If desired, the tray of the present invention may be formed of other, more or less equivalent material, many of the structural advantages of the tray deriving from its geometry. For example, the tray may be formed of plastic foam, such as structural cellular polystyrene foam comprising on the order of 70% void space, or porous polyolefin material or other open cell plastic, or a biodegradeable plastic such as biodegradeable foam polystyrene. However, if formed of materials having different strength characteristics, such as conventional foam polystyrene, various changes in the geometry may be necessary and certain advantages may be absent.

It will be understood that visibility in the tray of the present invention is excellent. For example, up to 85% view of the contents, depending in part upon the height of the opaque side and end walls, and also depending upon the configuration of the produce itself, may be visible.

It will be understood that the tray of the present may be made in various sizes and with various numbers of open windows in the bottom wall thereof. In the illustrated embodiment, besides providing a side and end wall height of approximately 1 inch, which is the preferred height for trays of all sizes according to the present invention, each open window measures approximately 13/16 of an inch and each rib 20 and 22 is approximately ¼ of an inch wide.

Having described some specific embodiments with reference to the drawings above, it should now be clear that an important feature of the present invention is that the ribs do not extend upwardly nor do they extend into any of the four side walls; on the contrary, they remain generally flat on the inside of the tray and extend directly from the annular portion 30. The rib configuration wherein a thickness of about 90–100 mils is provided having a slight indentation 26 along the bottom thereof is able to present not only a broad support area for fruit to reduce cutting and bruising thereof, but in addition there is some bottom flexibility which allows the ribs to "give" somewhat, and also allows the ribs to conform somewhat to the produce contained in the tray where the packages are stacked.

Trays 10 in accordance with the present invention, of various sizes, allow for maximum product visibility, with the least produce cutting and bruising. Toward this end, the rib size and shape that separates the window areas gives a larger and smoother support area than in any prior tray. Considering the effect of stacked packages, the ribs do not present any significant protrusions which could bruise the fruit when one package is stacked above another. The rib form used in the grid is deliberately able to flex rather than being structurally stiff, and this allows some accommodation to the contour of the packaged produce to again help reduce bruising.

In addition, the flexible bottom structure is able to function in a packaging tray to produce sufficient strength because of its combination with the lip 18, the latter giving a flexible shock-absorbing action for the stress of overwrap handling, while still providing sufficient strength and rigidity. The trays are sufficiently flexible so that when overwrapped with the film, the tray tends to wrap around the produce thereby giving enhanced protection.

The trays of the present invention and particularly the bottom grid form thereof, gives several advantages in a produce tray for packing the range of products normally sold at the retail level:

(1) A line of produce trays that give product visibility top and bottom—enough visibility to fairly represent the product in a way that allows consumers to make product quality judgment. The rib design gives excellent product visibility, yet gives an adequate bearing area of produce support to further reduce cutting or bruising.

(2) A rib configuration with broad support areas and no sharp edges, thereby holding produce without cutting and bruising which could reduce product quality.

(3) A rib configuration that is strong enough to resist store and consumer handling, yet flexible enough to yield and accommodate to the contours of the produce packaged, thereby further reducing bruising. There is sufficient tray strength to resist the pressures of wrapping and handling.

(4) A configuration without sharp edges on the bottom of the tray, inside and outside, so that packages cannot bruise or cut the contained produce, or the neighboring packages, even when stacked.

(5) The rib design can flex to accommodate the irregularities of produce size or shape when packaged. This is important to fruit inside the package, and even more important to reduce cutting and bruising of produce in other packages as the trays are stacked in display case of the supermarket.

It will be obvious to those skilled in the art that various changes may be made without departing from the scope of the invention and therefore the invention is not limited to what is shown in the drawings and described in the specification but only as indicated in the appended claims.

What is claimed is:

1. In a generally rectangular one-use, throw-away tray molded of inexpensive opaque material and primarily for the packaging of produce in conjunction with a transparent overwrap film-heat sealed thereabout, said tray comprising a pair of upwardly and outwardly inclined opposite side walls, each of said side walls forming a long side of said tray; a pair of upwardly and outwardly inclined opposite end walls, each of said end walls being adjacent to each said side wall and disposed at generally right angles thereto and thereby forming the rectangular configuration of said tray; a peripheral lip extending about said tray at the top of said end and side walls; and bottom wall means for providing visibility to the bottom interior of the tray for supporting the produce at the bottom of said tray; the improvement wherein:

said bottom wall means for providing visibility to the bottom of said tray comprises a plurality of generally flat ribs extending across said tray in at least two directions to define therebetween a plurality of open windows, said ribs constituting window frame structure around each open window and being of generally trapezoidal cross-section with a width approximately two and one-half times as great as the thickness thereof, the upper surface edges thereof being rounded with the terminal peripheral portion of each window frame being located substantially below the upper surfaces of said ribs; said end and side walls extending into a curved annular portion surrounding the open windows, and said annular portion extending smoothly into the ends of said ribs on the interior of said tray.

2. A tray in accordance with claim 1 wherein the height of said side walls is approximately ten times the thickness of said ribs.

3. A tray in accordance with claim 1 wherein each of said ribs has a longitudinal depression in the bottom thereof.

4. A tray in accordance with claim 1 molded of wood pulp.

5. A tray in accordance with claim 3 molded of wood pulp with a screen textured inner surface.

6. A tray in accordance with claim 1 wherein some of said ribs extend across said tray generally parallel to said side walls, and the remainder of said ribs extend across said tray generally parallel to said end walls, said rib crossing at substantial right angles to define said open windows.

7. A tray in accordance with claim 1 wherein the thickness of said ribs is about 20% greater than the thickness of said side walls.

* * * * *